US010584497B2

(12) United States Patent
Studebaker et al.

(10) Patent No.: US 10,584,497 B2
(45) Date of Patent: Mar. 10, 2020

(54) ROOF CLEANING PROCESSES AND ASSOCIATED SYSTEMS

(71) Applicant: Dri-Eaz Products, Inc., Burlington, WA (US)

(72) Inventors: Keith Studebaker, Tumwater, WA (US); William Bruders, Sedro Woolley, WA (US); Dennis P. Bruders, Brier, WA (US); Kevin J. Miller, Prescott Valley, AZ (US); Brett Bartholmey, Bellingham, WA (US)

(73) Assignee: Dri-Eaz Products, Inc., Burlington, WA (US)

( * ) Notice: Subject to any disclaimer, the term of this patent is extended or adjusted under 35 U.S.C. 154(b) by 186 days.

(21) Appl. No.: 14/868,212

(22) Filed: Sep. 28, 2015

(65) Prior Publication Data

US 2016/0160506 A1 Jun. 9, 2016

Related U.S. Application Data

(60) Provisional application No. 62/088,525, filed on Dec. 5, 2014.

(51) Int. Cl.

| | |
|---|---|
| ***E04D 15/00*** | (2006.01) |
| ***A47L 11/38*** | (2006.01) |
| ***A47L 11/40*** | (2006.01) |

(52) U.S. Cl.

CPC ..... *E04D 15/006* (2013.01); *A47L 11/38* (2013.01); *A47L 11/4044* (2013.01); *A47L 11/4083* (2013.01); *A47L 11/4088* (2013.01)

(58) Field of Classification Search

CPC .. A47L 11/38; A47L 11/4044; A47L 11/4083; A47L 11/4088; E04D 13/106;

(Continued)

(56) References Cited

U.S. PATENT DOCUMENTS

| | | | |
|---|---|---|---|
| 695,162 | A | 3/1902 | Lotz |
| 862,695 | A | 8/1907 | Baldwin |

(Continued)

FOREIGN PATENT DOCUMENTS

| | | |
|---|---|---|
| GB | 2437484 | 10/2007 |
| JP | 2002311192 A | 10/2002 |

(Continued)

OTHER PUBLICATIONS

UltimateWasher.com, "UltimateWasher", retrieved from "Wayback Machine" dated to Feb. 24, 2013 from http://www.ultimatewasher.com/articles/tile-roof-cleaning.htm, http://ultimatewasher.com/water-recovery-systems.htm, http://www.ultimatewasher.com/hot-electric-power-washers.htm, http://www.ultimatewasher.com/water-containment-system.*

(Continued)

*Primary Examiner* — Nadine G Norton
*Assistant Examiner* — Christopher Remavege
(74) *Attorney, Agent, or Firm* — Perkins Coie LLP

(57) ABSTRACT

Roof cleaning processes and associated systems are disclosed. A representative process includes dispensing a cleaning fluid on the roof, at least restricting the cleaning fluid from exiting the roof via a roof drain, and collecting the cleaning fluid from the roof and directing the cleaning fluid to a sanitary sewer. A representative system includes a pump coupleable to a source of water and configured to pressurize the water, a surface cleaner coupled to the pump with a water line to receive pressurized water, a vacuum source coupled to the surface cleaner with a vacuum line to remove wastewater produced by the surface cleaner, and a retainer configured to be removably attached to a building at least proximate to a roof of the building, the retainer being removably coupleable to the vacuum line and the water line (Continued)

to at least restrict movement of the vacuum line and the water line.

17 Claims, 10 Drawing Sheets

(58) Field of Classification Search
CPC ..... E04D 15/00; E04D 15/003; E04D 15/006; F16L 3/003; F16L 3/02; F16L 3/23; F16L 3/24; A62C 33/06
USPC .... 134/6, 10, 18, 21, 26, 32, 33, 34, 36, 42; 248/48.1, 48.2, 49, 56, 59, 65, 68.1, 72, 248/73, 75, 237
See application file for complete search history.

(56) References Cited

U.S. PATENT DOCUMENTS 1,211,948 A 1/1917 Koster et al.
1,498,255 A 6/1924 Winchester
1,654,727 A 1/1928 Green
1,746,151 A * 2/1930 Goldman ..... F16L 3/003 248/79
2,000,930 A 5/1935 De Nagy
2,063,253 A 12/1936 Kuhnel
2,317,843 A 4/1943 Backlund
2,480,906 A * 9/1949 Cox ..... B05B 15/622 248/88
2,592,053 A * 4/1952 Megla ..... D06F 1/00 248/79
2,624,063 A 1/1953 Van Der Heem
2,671,920 A 3/1954 Finnell
2,744,272 A 5/1956 Theis et al.
2,764,394 A 9/1956 Miller
2,904,817 A 9/1959 Brennan et al.
2,999,258 A 9/1961 Berberian
3,243,832 A 4/1966 Allen et al.
3,341,081 A 9/1967 King
3,381,326 A 5/1968 Dolan et al.
3,402,420 A 9/1968 Schaeffer
3,408,673 A 11/1968 Oxel
3,550,181 A 12/1970 Dolan et al.
3,619,848 A 11/1971 Salzmann
3,623,177 A 11/1971 Pack
3,624,668 A 11/1971 Helmuth
3,649,995 A 3/1972 Ison
3,686,707 A 8/1972 Hughes
3,696,689 A 10/1972 Loula et al.
3,720,977 A 3/1973 Brycki
3,755,850 A 9/1973 Porter
3,774,260 A 11/1973 Emus
3,775,053 A 11/1973 Wisdom
3,840,935 A 10/1974 Fitzgerald, Jr. et al.
3,841,910 A 10/1974 Baker
3,849,823 A 11/1974 Adamson et al.
3,864,784 A 2/1975 Kilstrom et al.
3,940,826 A 3/1976 Phillips et al.
4,006,506 A 2/1977 Burgoon
4,014,067 A 3/1977 Bates
4,027,649 A 6/1977 Jackson
4,037,290 A 7/1977 Rose et al.
4,074,385 A 2/1978 Howard
4,075,733 A 2/1978 Parise
4,083,077 A 4/1978 Knight
4,088,462 A 5/1978 Laule et al.
4,095,309 A 6/1978 Sundheim
4,107,816 A 8/1978 Matthews
4,109,340 A 8/1978 Bates
4,120,070 A 10/1978 Severin
4,121,915 A * 10/1978 Anderson ..... A47L 9/182 15/340.1
4,137,600 A 2/1979 Albishausen
4,139,922 A 2/1979 Fitch
4,146,944 A 4/1979 Pinto
4,153,968 A 5/1979 Perkins
4,154,578 A 5/1979 Bane
4,158,248 A 6/1979 Palmer
4,161,802 A 7/1979 Knight
4,166,368 A 9/1979 Beninca
4,167,799 A 9/1979 Webb
4,182,001 A 1/1980 Krause
4,186,459 A 2/1980 Wulff
4,191,590 A 3/1980 Sundheim
4,194,262 A 3/1980 Finely
4,196,492 A 4/1980 Johnson
4,210,978 A 7/1980 Johnson
4,219,902 A 9/1980 DeMaagd
4,227,893 A 10/1980 Shaddock
4,234,995 A 11/1980 Parise
4,240,569 A 12/1980 Bessinger
4,244,079 A 1/1981 Bane
4,264,999 A 5/1981 Monson
4,267,618 A 5/1981 Cuscovitch
4,268,935 A 5/1981 Bessinger
4,270,238 A 6/1981 Shallenberg
4,272,861 A 6/1981 Notta
4,282,626 A 8/1981 Schneider
4,284,127 A 8/1981 Collier
4,330,804 A 5/1982 Buchner
4,333,204 A 6/1982 Monson
4,335,486 A 6/1982 Kochte
4,339,840 A 7/1982 Monson
4,349,935 A 9/1982 Knestele
4,353,145 A 10/1982 Woodford
4,360,946 A 11/1982 Marshall et al.
4,377,018 A 3/1983 Cain
4,392,270 A 7/1983 Magee
4,400,846 A 8/1983 Sanderson
4,407,041 A 10/1983 Goldsmith
4,441,229 A 4/1984 Monson
4,457,042 A 7/1984 Jones et al.
4,458,377 A 7/1984 Frohbieter
4,464,810 A 8/1984 Karpanty
4,488,330 A 12/1984 Grave
4,521,935 A 6/1985 Johnson
4,534,746 A 8/1985 Hausinger
4,542,556 A 9/1985 Hepple
4,544,702 A 10/1985 DeVera
4,571,849 A 2/1986 Gardner et al.
4,595,420 A 6/1986 Williams
4,649,594 A 3/1987 Grave
4,654,925 A 4/1987 Grave
4,692,959 A 9/1987 Monson
4,696,974 A 9/1987 Cavelli
4,720,889 A 1/1988 Grave
4,731,956 A 3/1988 Wood
D295,092 S 4/1988 Mizuno et al.
4,809,397 A 3/1989 Jacobs
4,862,551 A 9/1989 Martinez et al.
4,879,784 A 11/1989 Shero
D306,788 S 3/1990 McAllister et al.
4,989,294 A 2/1991 Fischer
5,048,148 A 9/1991 Gleadall
5,101,532 A 4/1992 Dyson
5,103,527 A 4/1992 Holland
5,105,503 A 4/1992 Holland
5,116,425 A 5/1992 Ruef
5,157,805 A 10/1992 Pinter
5,165,139 A 11/1992 Oxman
5,218,737 A 6/1993 Dansby et al.
5,237,719 A 8/1993 Dwyer, Jr. et al.
5,249,325 A 10/1993 Wilen
5,287,591 A 2/1994 Rench
D345,234 S 3/1994 Iorli
5,312,044 A 5/1994 Eaton
5,347,678 A 9/1994 Williams
5,363,535 A 11/1994 Rench
5,371,918 A 12/1994 Shero
5,392,492 A 2/1995 Fassauer
5,394,585 A 3/1995 Connelly
5,430,910 A 7/1995 Wiley
5,438,728 A 8/1995 Kubes
5,463,791 A 11/1995 Roden

(56) References Cited

U.S. PATENT DOCUMENTS 5,465,456 A 11/1995 Fellhauer
5,485,651 A 1/1996 Payeur
5,485,652 A 1/1996 Holland
5,522,114 A 6/1996 Allison
5,555,598 A 9/1996 Grave
5,555,599 A 9/1996 Markley
5,561,884 A 10/1996 Nijland
5,587,021 A 12/1996 Hoersch
5,596,788 A 1/1997 Linville
5,613,271 A 3/1997 Thomas
5,632,670 A 5/1997 Gwyther
D381,144 S 7/1997 Moine et al.
5,706,549 A 1/1998 Legatt et al.
5,752,289 A 5/1998 Collins
5,778,646 A 7/1998 Pfisterer
5,815,869 A 10/1998 Hopkins
5,867,861 A 2/1999 Kasen
5,867,864 A 2/1999 Miller et al.
5,970,574 A 10/1999 Thrash, Jr.
6,013,227 A 1/2000 Lin et al.
6,016,973 A 1/2000 Thompson
6,032,326 A 3/2000 Roden et al.
6,052,854 A 4/2000 Besel
6,052,861 A 4/2000 Keller
D424,766 S 5/2000 Martin
6,125,495 A 10/2000 Berg
6,151,748 A 11/2000 Earhart
6,151,784 A 11/2000 Maruyama
6,192,547 B1 2/2001 Song
6,243,914 B1 6/2001 Studebaker
6,247,480 B1 * 6/2001 Wegner ..... B01D 17/0208 134/111
6,266,892 B1 7/2001 Haynie
6,298,577 B1 10/2001 Haynie
6,367,109 B1 4/2002 Besel
6,370,728 B1 4/2002 Burns
6,413,323 B2 7/2002 Shook et al.
6,421,875 B1 7/2002 Coombs et al.
D468,499 S 1/2003 Kitts
6,560,817 B2 5/2003 Deiterman
D479,636 S 9/2003 Kitts
6,648,281 B1 * 11/2003 Lake ..... A62C 33/06 248/49
6,684,452 B2 2/2004 Lehman
6,705,332 B2 3/2004 Field
6,789,290 B2 9/2004 Kent
6,981,338 B2 1/2006 Jensen et al.
D518,259 S 3/2006 Wertz
D520,202 S 5/2006 Dyson et al.
D522,197 S 5/2006 Dyson et al.
7,070,662 B2 7/2006 Studebaker
RE39,422 E 12/2006 Clemons
7,159,271 B2 1/2007 Sepke et al.
D538,986 S 3/2007 Ingram
RE39,623 E 5/2007 Studebaker
7,299,521 B2 11/2007 Theiss
D565,262 S 3/2008 Dyson et al.
7,337,491 B2 * 3/2008 McMillen ..... B08B 3/026 15/302
7,370,386 B2 5/2008 Lehman
7,392,566 B2 7/2008 Gordon et al.
7,530,135 B2 5/2009 Benedict
7,624,474 B1 12/2009 Cho
RE41,367 E 6/2010 Studebaker
7,758,702 B1 7/2010 Huffman
7,793,385 B2 9/2010 Huffman
D635,315 S 3/2011 Wertz
7,915,567 B2 3/2011 Lhuillier
7,962,995 B2 6/2011 Allaway
D643,169 S 8/2011 Calvert
D663,909 S 7/2012 Andreesen
8,453,293 B1 6/2013 Monson
8,510,902 B2 8/2013 Kappos
8,632,037 B1 * 1/2014 Rael ..... F16L 3/003 248/534
9,066,647 B2 6/2015 Kappos
9,127,419 B2 * 9/2015 Robinson ..... B08B 3/024
9,175,790 B2 * 11/2015 Schiller ..... F16L 3/02
9,303,168 B2 * 4/2016 Sokol ..... C09D 133/08
9,402,523 B2 8/2016 Studebaker et al.
9,927,050 B2 3/2018 LaBarbera et al.
2002/0178529 A1 12/2002 Geyer et al.
2002/0190145 A1 * 12/2002 Sheppard, Jr. ..... B05B 9/007 239/754
2005/0022332 A1 * 2/2005 McMillen ..... B08B 3/026 15/320
2005/0109470 A1 * 5/2005 Freudenberg ..... E04G 21/30 160/135
2005/0144751 A1 7/2005 Kegg et al.
2005/0242245 A1 * 11/2005 Balderama ..... B64C 1/406 248/65
2005/0283936 A1 * 12/2005 Barker ..... A47L 11/4091 15/320
2006/0143843 A1 7/2006 Benedict
2006/0196074 A1 9/2006 Vilhunen
2007/0079472 A1 4/2007 Carter et al.
2007/0113368 A1 5/2007 Alexander
2007/0226943 A1 10/2007 Lenkiewicz et al.
2007/0251047 A1 11/2007 Monson
2008/0094784 A1 4/2008 Adunka et al.
2008/0141483 A1 6/2008 Pearlstein
2008/0163562 A1 * 7/2008 Conant ..... E04D 13/0765 52/16
2009/0038105 A1 2/2009 Mayer
2010/0024244 A1 2/2010 Potter
2010/0212688 A1 * 8/2010 Goff ..... A47L 11/305 134/6
2012/0151708 A1 6/2012 Carter et al.
2012/0233804 A1 9/2012 Studebaker et al.
2013/0193231 A1 * 8/2013 Mologousis ..... B05B 15/06 239/172
2014/0099512 A1 4/2014 Sokol
2014/0115816 A1 5/2014 Bruders et al.
2014/0137895 A1 * 5/2014 Bruders ..... A47L 11/4044 134/21
2015/0136176 A1 5/2015 Aldrich

FOREIGN PATENT DOCUMENTS

WO WO-0106188 A1 1/2001
WO WO-2005118959 A1 12/2005

OTHER PUBLICATIONS

U.S. Appl. No. 14/752,624, filed Jun. 26, 2015, Kappos.
Internet Publication "Positive vs. Negative Angles," ; http://www4.nau.edu/ifwd/ts_lessons/angle/angle_upload/A_posneg.htm, 1 page, 2003.
"TMF Review: Flash Xtractor by Waterclaw,"; http://www.youtube.com/watch?v=ts0xmTmBFsY, ; uploaded Jul. 2, 2010, 1 page.

* cited by examiner

ROOF CLEANING PROCESSES AND ASSOCIATED SYSTEMS

CROSS-REFERENCE TO RELATED APPLICATION

The present application claims priority to U.S. Provisional Application No. 62/088,525, filed on Dec. 5, 2014 and incorporated herein by reference.

TECHNICAL FIELD

The present technology is directed generally to roof cleaning processes and associated systems.

BACKGROUND

In addition to shielding the interior of a building from wind and rain, the roof of the building can reflect sunlight that impinges on the building. Accordingly, particularly in warm climates, building roofs are often made of light (e.g., white) materials to increase the reflectivity of the roof and aid in keeping the interior of the building cool. One drawback with such roofs is that they accumulate dirt over the course of time, which reduces the reflectivity of the roof and therefore the ability of the roof to keep the building interior cool. One approach to addressing this drawback is to periodically clean the roof, for example, by pressure washing or scrubbing the roof. However, this process is labor-intensive and typically uses a significant quantity of water, which is not always readily available in the warm climates where such roofs are most useful. In addition, typical roof cleaning processes include using detergents and surfactants, which are then washed down the building gutters into storm sewers and/or other channels that in turn direct the contaminated water into streams, lakes, aquifers and/or other natural environmental areas without treating it. Still further, non-reflective and reflective roofs can also suffer physical damage from debris buildup. For example, as organic materials build up on the roof's surface, they support the growth of fungi and/or moss, which can damage the roof structure. Accordingly, there remains a need for improved systems and techniques for cleaning roofs.

DETAILED DESCRIPTION

Figure 1:
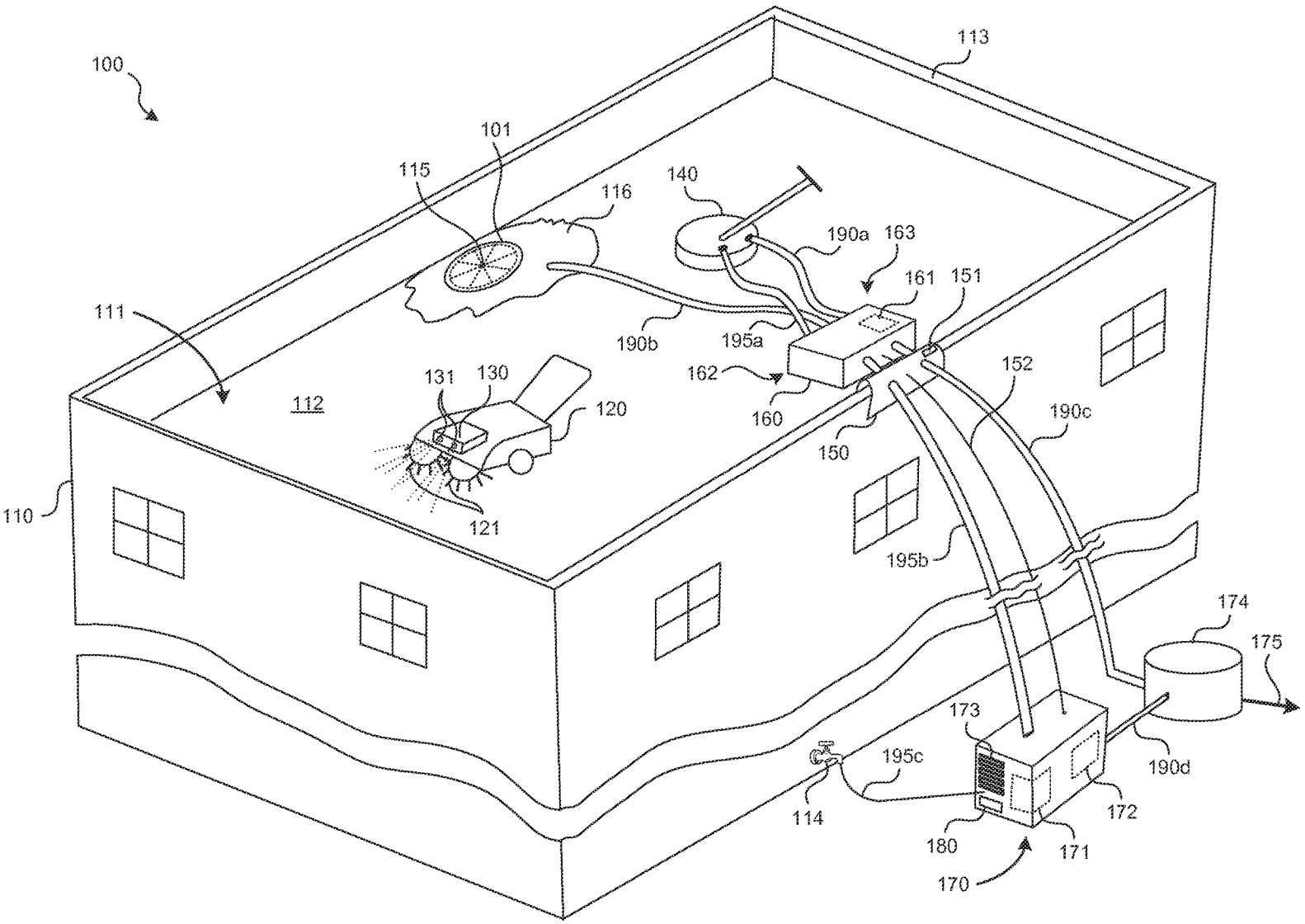
FIG. 1 is a partially schematic, isometric illustration of a system configured to clean a building roof in accordance with an embodiment of the present technology.

The present technology is directed generally to apparatuses, systems, devices, and methods for cleaning building roofs. Methods in accordance with particular embodiments of the disclosed technology can be used to clean building roofs without surfactants or other chemicals that may be harmful to the environment. In addition, the water used to clean the roofs can be captured, filtered, and directed to a sanitary sewer (e.g., a sewer coupled to a wastewater treatment plant), and/or reused or recycled, so as to reduce or eliminate potentially contaminated water that is discharged directly into the environment.

Several details describing structures or processes that are well-known and often associated with these types of systems or processes, but that may unnecessarily obscure some significant aspects of the presently disclosed technology, are not set forth in the following description for purposes of clarity. Furthermore, although the following disclosure sets forth several embodiments of different aspects of the disclosed technology, several other embodiments can have different configurations and/or different components than those described in this section. Accordingly, the disclosed technology may include other embodiments with additional elements not described below with reference to FIGS. 1-6B, and/or without several of the elements described below with reference to FIGS. 1-6B.

Several embodiments of the technology described below may take the form of computer-executable instructions, including routines executed by a programmable computer and/or controller. Those skilled in the relevant art will appreciate that the technology can be practiced on computer and/or controller systems other than those shown and described below. The technology can be embodied in a special-purpose computer, controller and/or data processor that is specifically programmed, configured or constructed to perform one or more of the computer-executable instructions described below. Accordingly, the terms "computer" and "controller" as generally used herein refer to any suitable data processor and can include Internet appliances and hand-held devices (including palm-top computers, wearable computers, cellular or mobile phones, multi-processor systems, processor-based or programmable consumer electronics, network computers, mini computers and the like). Information handled by these computers can be presented at any suitable display medium, including a CRT display or LCD.

The technology can also be practiced in distributed environments, where tasks or modules are performed by remote processing devices that are linked through a communications network. In a distributed computing environment, program modules or subroutines may be located in local and remote memory storage devices. Aspects of the technology described below may be stored or distributed on computer-readable media, including magnetic or optically readable or removable computer disks, as well as distributed electronically over networks. Data structures and transmissions of data particular to aspects of the present technology are also encompassed within the scope of the present technology.

FIG. 1 is a partially schematic, isometric illustration of a system 100 positioned to clean the roof 111 of a structure 110. The roof 111 can have an upwardly-facing surface 112 that is generally flat, but can be sloped so as to direct rainwater to one or more drains 115. The drains 115 are typically connected to gutters that direct rainwater into a storm sewer or other untreated water collection and discharge system. Embodiments of the system 100 are configured to clean the roof surface 112 more quickly and efficiently than conventional systems, and/or to prevent or significantly restrict wastewater from being discharged into the environment without treatment.

The system 100 can include components that are positioned on the roof 111 for cleaning, and other components that are positioned on the ground to support the cleaning operation. The components on the roof can include a sweeper 120 that is used to pre-clean the roof by sweeping up larger solid debris. Accordingly, the sweeper 120 can include counter-rotating brushes 121 that sweep the debris into an on-board bin, which is then emptied as needed.

In a typical operation, a chemical pre-cleaning solution can be disposed on the roof surface 112 prior to further cleaning the roof. The pre-cleaning solution can facilitate loosening algae, fungus, dirt, and/or other debris from the roof surface 112 so that the debris can be more readily removed. In a particular aspect of an embodiment shown in FIG. 1, the sweeper 120 can include a pre-cleaning fluid applicator 130 that directs the pre-cleaning fluid onto the roof surface 112 via one or more nozzles 131. Accordingly, an operator can both sweep up the larger solid debris and dispense the pre-cleaning fluid using a single device that simultaneously completes both operations. This approach can reduce the amount of labor, time and/or expense required to clean the roof 111.

In a typical conventional cleaning process, the pre-cleaning fluid and other fluids (including water) used during the cleaning operation are discharged directly into the environment via the roof drain 115. In one aspect of the present technology, the system 100 can include one or more drain covers 101 that cover one or more corresponding drains 115 and prevent or at least significantly restrict the passage of fluids and solids into the drain 115 and therefore reduce or eliminate the amount of untreated fluid discharged directly into the environment.

After the roof 111 has been swept and has received the pre-cleaning fluid, the remaining debris is removed using a cleaning tool 140. In a particular embodiment, the cleaning tool 140 receives pressurized water from a tool water line 195*a* and sprays the pressurized water downwardly onto the roof surface 112. For example, the cleaning tool 140 can include a rotating arm with downwardly-facing nozzles that direct the pressurized water against the roof surface 112. The pressurized water can include an environmentally "friendly" cleaning solution (e.g., a biodegradable cleaning solution) to facilitate removing debris from the roof surface 112, and reducing the burden on downstream waste treatment systems. Representative rotary cleaning tools for cleaning hard surfaces are disclosed in co-pending U.S. application Ser. No. 13/844,029, filed on Mar. 15, 2013 and incorporated herein by reference. To the extent the foregoing application and/or any other materials incorporated herein by reference conflict with the present disclosure, the present disclosure controls. Further suitable rotary cleaners are available from Tremco, Inc. of Beachwood, Ohio and Legend Brands of Burlington, Wash.

The cleaning tool 140 is coupled to a tool vacuum line 190*a* that receives wastewater and debris loosened by the cleaning tool 140 and directs the wastewater to a wastewater tank 174, typically located on the ground (e.g., directly on the ground, or on a ground-based platform, such as a truck, trailer, or other mobile device). The wastewater tank 174 and other ground-based equipment are described further below.

The ground-based equipment can include a fluid handling unit 170, which is configured to provide pressurized water to the cleaning tool 140, and/or receive soiled wastewater from the cleaning tool 140. In a particular embodiment, the fluid handling unit 170 includes a power source 171 (e.g., an internal combustion engine) that provides power for carrying out the foregoing operations. For example, the power provided by the power source 171 can drive a pump 180. The pump 180 pressurizes water received from a water supply 114 (e.g., an external faucet on the structure 110) via a low pressure water supply line 195*c*. The pressurized water can be heated so as to improve the efficiency with which the water removes dirt from the roof surface 112. Accordingly, the fluid handling unit 170 can include a heat exchanger 173 that heats the pressurized water. In a particular aspect of this embodiment, the heat exchanger 173 can receive heat from the power source 171. For example, when the power source 171 includes an internal combustion engine, the heat exchanger 173 can receive heat from the exhaust gas flow produced by the engine. In other embodiments, other techniques (e.g., using electrical or gas-fired heaters) can be used to heat the water. In any of these embodiments, the pressurized, heated water is then directed to the roof 111 via a roof water line 195*b*.

The power source 171 can also be used to provide the vacuum force that directs the soiled water from the cleaning tool 140 to the wastewater tank 174. For example, the power source 171 can be coupled to a blower or other vacuum source 172, which draws a vacuum on the wastewater tank 174 via a tank vacuum line 190*d*. The wastewater tank 174 is in turn coupled to a roof vacuum line 190*c*, which is in turn coupled to the tool vacuum line 190*a*. Accordingly, the vacuum provided by the vacuum source 172 draws wastewater into the wastewater tank 174. An operator can periodically empty the wastewater tank 174 via a wastewater outlet 175. The removed wastewater can be directed into a sanitary sewer system, for example, the sewer system that normally receives wastewater from the sinks, toilets, etc., in the structure 110 and directs that wastewater to a suitable waste treatment facility.

In a particular embodiment, the system 100 includes a retainer 150 configured to secure the various fluid lines as they pass between the roof 111 and the ground. For example, the retainer 150 can be clamped or otherwise releasably attached to a parapet 113 that surrounds or partially surrounds the roof surface 112, and can hold the fluid lines in position. Accordingly, the retainer 150 can provide strain relief for the fluid lines, and can reduce (e.g., minimize) the likelihood that the motion of the fluid lines on the roof 111 has any effect on the fluid lines below, and vice versa.

The system 100 can further include a rooftop unit 160 to which the roof water line 195*b* and the roof vacuum line 190*c* are connected. The rooftop unit 160 can then process and/or direct the fluids it receives. For example, the rooftop unit 160 can include a supply water manifold 162 to which the tool water line 195*a* is attached. The rooftop unit 160 can also include a vacuum manifold 163 to which the tool vacuum line 190*a* is attached. Each manifold can include multiple outlets. For example, the vacuum manifold 163 can also be coupled to a drain vacuum line 190*b* that extends to or near the roof drain or drains 115. Accordingly, wastewater 116 that may not be collected by the cleaning tool 140, and that may instead run toward the drain 115 (due to the slope of the roof surface 112) can be collected and directed to the wastewater tank 174 via the drain vacuum line 190*b*. This arrangement can further ensure that little or no wastewater from the cleaning process escapes into the environment via the drain 115.

In a particular embodiment, the rooftop unit 160 can also include a filter 161 that prefilters the wastewater received from the cleaning tool 140, before the wastewater is directed to the wastewater tank 174. The filter 161 can remove all or a significant portion of the solid debris collected by the cleaning tool 140 so as to prevent this material from being directed to the sanitary sewer. Accordingly, the filter 161 can include one or more baffles and/or one or more filter elements (e.g., a series of graded filter elements) to remove solid materials from the waste stream. The material collected at the filter 161 can periodically be removed and disposed of via proper channels.

The system 100 can further include a remote control unit 151 that allows operators on the roof 111 to control at least some operational features of the fluid handling unit 170 on the ground. The remote control unit 151 can be located at the retainer 150 or at other locations, for example, at the rooftop unit 160. In a representative embodiment, the remote control unit 151 is wired to the fluid handling unit 170 via one or more signal lines 152. In other embodiments, the remote control unit 151 can be wireless so that an operator can move it to any suitable location, on the roof 111 or elsewhere. In a representative embodiment, the remote control unit 151 can be used to shut down the high pressure pump 180 of the fluid handling unit 170, and/or the vacuum source 172, and/or the entire fluid handling unit 170.

Figure 2:
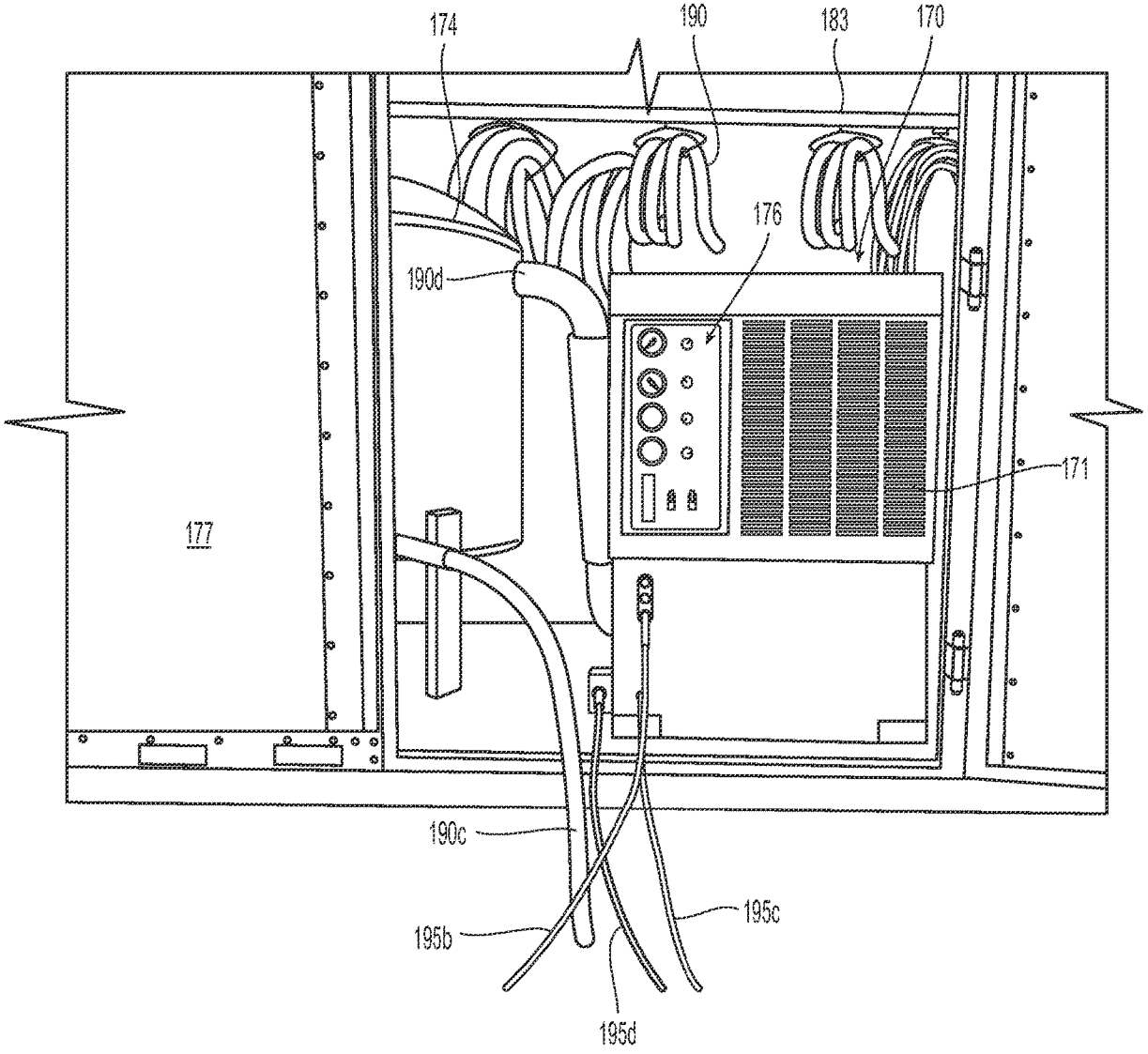
FIG. 2 is an illustration of a truck-mounted fluid handling unit used for roof cleaning processes in accordance with an embodiment of the present technology.

FIG. 2 is a partially schematic illustration of a representative fluid handling unit 170 configured in accordance with an embodiment of the present technology. In this particular embodiment, the fluid handling unit 170 is mounted on or in a truck 177 (a portion of which is shown in FIG. 2) so as to be easily transported from one cleaning site to another. The fluid handling unit 170 includes a central control unit 176 that is used to control the functions of the power source 171 and/or other components of the fluid handling unit 170 (some of which are not visible in FIG. 2). The power source 171 can be separate from the engine used to propel the truck 177 (e.g., a separate internal combustion engine), or the fluid handling unit 170 can receive power from the truck's engine, e.g., via a hydraulic, mechanical, or other power take-off (PTO) device. As shown in FIG. 2, the fluid handling unit 170 is coupled to the water supply 114 (FIG. 1) via the low pressure water supply line 195*c*. The high pressure water produced by the fluid handling unit 170 is directed to the roof via the roof water line 195*b*. The fluid handling unit 170 is coupled to the wastewater tank 174 via the tank vacuum line 190*d*, and the wastewater tank 174 is coupled to the cleaning tool 140 (FIG. 1) via the roof vacuum line 190*c*. The wastewater tank 174 is drained via a pump-out line 195*d*, which is in turn coupled to a sanitary sewer during a discharge operation.

The truck 177 can also house the hoses and other equipment used during a typical cleaning operation. In a particular embodiment shown in FIG. 2, the truck 177 includes a rack 183 that removably supports multiple vacuum lines 190 and/or other fluid lines (e.g., pressurized water lines). Further details of a representative embodiment of the rack 183 are described later with reference to FIGS. 5A-5B.

Figure 3:
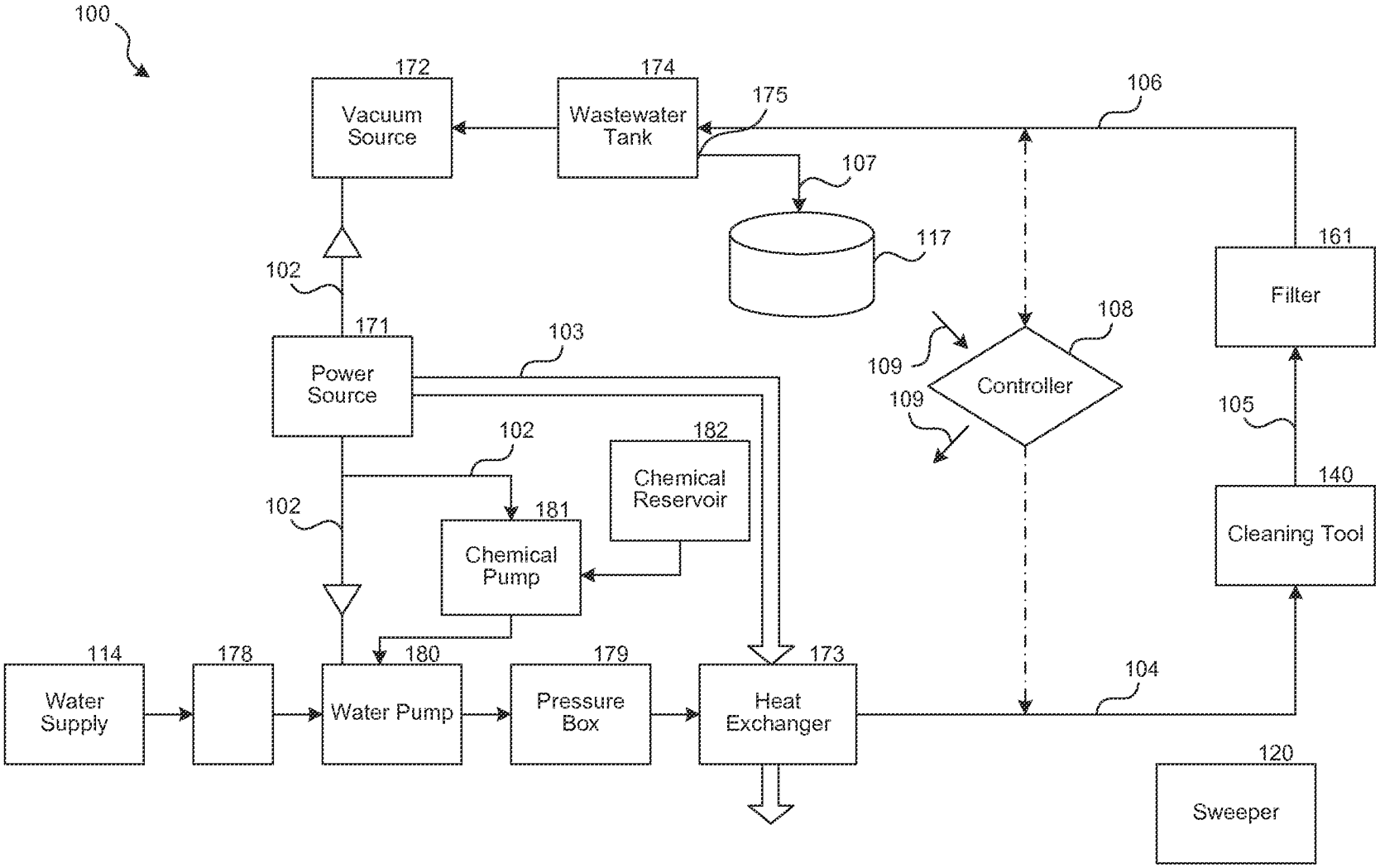
FIG. 3 is a schematic block diagram illustrating components of a roof cleaning system configured in accordance with an embodiment of the present technology.

FIG. 3 is a schematic diagram illustrating representative system components, many of which were described above with reference to FIGS. 1 and 2. As shown in FIG. 3, the power source 171 provides power 102 to multiple components of the system 100. In a representative embodiment, the power source 171 includes a 32 HP gasoline-powered internal combustion engine, and in other embodiments, the power source 171 can include other suitable devices. The components powered by the power source 171 can include the water pump 180, which receives low pressure water from the water supply 114 via a regulator 178, and produces high pressure water that is directed to a plenum or pressure box 179. In a representative embodiment, the pump 180 pressurizes the water to 2000 psi or more, at a flow rate of at least 3.5 gallons per minute, and in other embodiments, the pressure and flow rate of the water can have other suitable values.

In a particular embodiment shown in FIG. 3, the system 100 can further include a chemical reservoir 182 that houses one or more cleaning chemicals. The chemicals can be free of detergents, and are directed into the flow of water via a chemical pump 181. The chemical pump 181 can accordingly receive power from the power source 171 directly, or from the water pump 180. The resulting mixture (referred to as a cleaning solution or cleaning fluid) is directed to the heat exchanger 173. As discussed above, the heat exchanger 173 can receive heat from the power source 171 via an exhaust flow path 103. In a representative embodiment, the cleaning solution is heated to a temperature of 100° F. or more. In other embodiments, the cleaning fluid can be heated to other suitable temperatures. The heated cleaning solution 104 then flows under pressure to the cleaning tool 140

The power source 171 can also direct power 102 to the vacuum source 172. In a representative embodiment, the vacuum source 172 includes a mechanical vacuum blower, for example, having a capacity of at least 460 cubic feet per minute. In other embodiments, the vacuum source 172 can have other suitable configurations. In any of these embodiments, the vacuum source 172 draws a vacuum on the wastewater tank 174, which is in turn coupled to the cleaning tool 140 via the filter 161. In a representative embodiment, the vacuum source 172 draws a vacuum of approximately 18-20 inches of mercury below atmospheric pressure, and in other embodiments, the vacuum source 172 can produce other suitable levels of vacuum. In any of these embodiments, the force of the vacuum causes soiled water 105 to pass from the cleaning tool 140 through the filter 161. The filtered water 106 then passes into the wastewater tank 174. The collected wastewater 107 is then directed to a sanitary sewer 117 via an outlet 175 of the wastewater tank 174. In a particular embodiment, the wastewater tank 174 and/or other locations along the fluid flow path between the filter 161 and the sanitary sewer 117 can include further filters to further cleanse the wastewater before it is directed into the sanitary sewer 117. For example, the wastewater tank 174 can include one or more baffles and/or filters (e.g., a series of graded filters) to remove additional particulates from the wastewater prior to disposal.

The functions described above can be directed by one or more controllers 108. The controller 108 can include the central control unit 176 described above with reference to FIG. 2, and/or the remote control unit 151, described above with reference to FIG. 1. In any of these embodiments, the controller 108 can communicate with the various components of the system 100 via wired or wireless connections 109.

Figure 4:
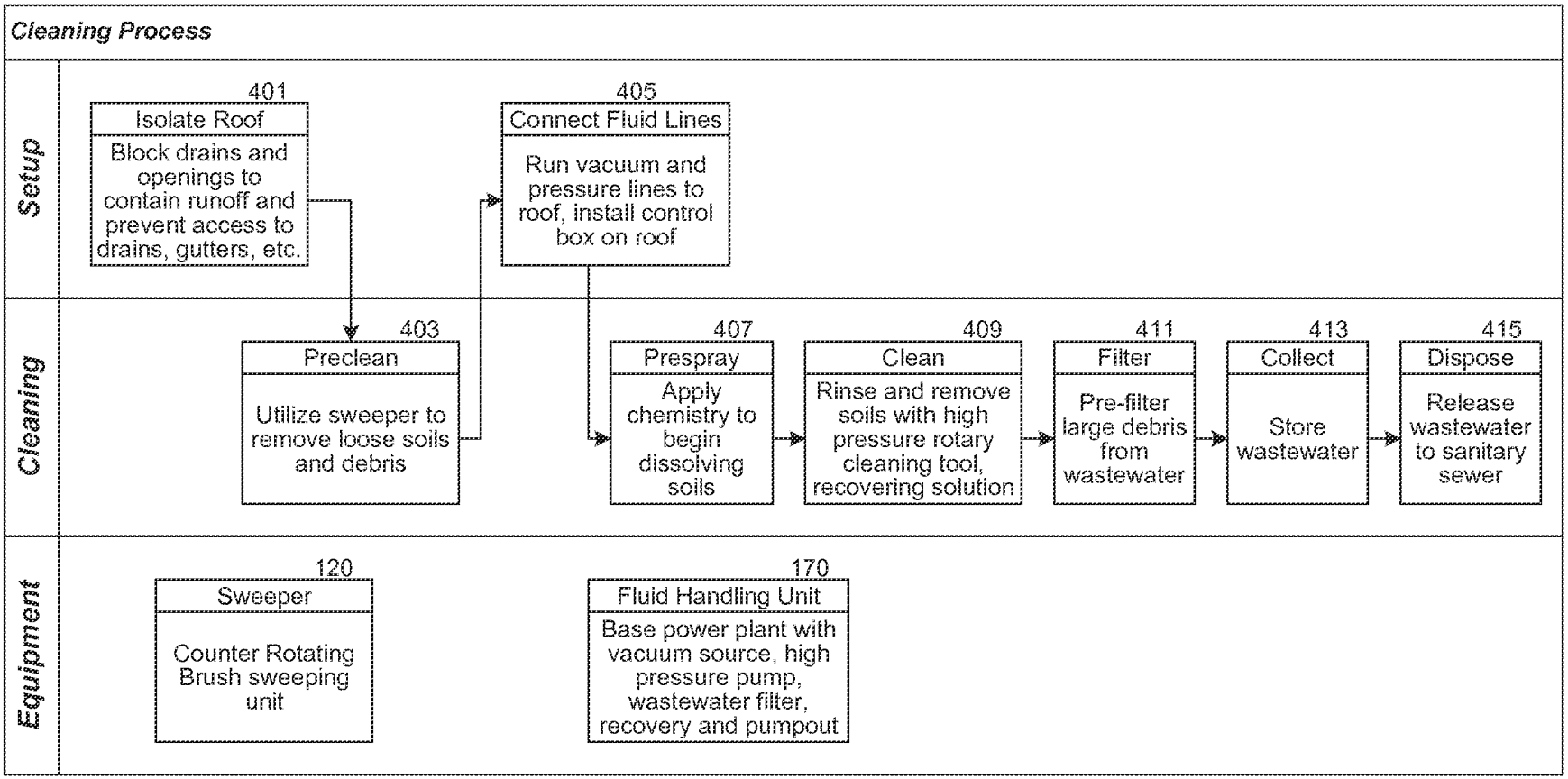
FIG. 4 is a flow diagram illustrating processes for cleaning a roof in accordance with embodiments of the present technology.

FIG. 4 is a block diagram illustrating a process for cleaning a roof in accordance with a representative embodiment of the present technology. In process portion or block 401, the roof is isolated or at least partially isolated from direct fluid communication with the surrounding environment. For example, process portion 401 can include blocking drains and openings that would otherwise direct the wastewater to gutters, and/or other outlets that are not connected to a sanitary sewer system, but that instead drain directly into the environment, or indirectly into the environment via a storm sewer system or other untreated disposal system. In process portion or block 403, the roof is pre-cleaned using a sweeper 120. The sweeper 120 can remove loose soils and debris. As discussed above, the sweeper can also be used to dispense a pre-cleaning fluid. In another embodiment, the pre-cleaning fluid can be dispensed separately, or can be eliminated.

In block 405, the fluid lines used to clean the roof are connected between the various components described above. For example, this process can include connecting vacuum and pressure lines between components on the roof structure, and components on the ground. In a typical operation, several sections of vacuum lines are connected together to provide fluid communication between equipment on the roof and equipment on the ground. A similar arrangement can be used for the pressurized water lines.

Block 407 includes a pre-spray process, which in turn includes applying a chemistry that initiates the process of dissolving soils. Representative pre-cleaning solutions are available from Tremco, Inc. of Beachwood, Ohio. In a representative process, a detergent-free and surfactant-free pre-cleaning solution is diluted at a rate of approximately 16 ounces per 5 gallons, and applied at a pressure of approximately 35 psi to cover 600 square feet per gallon. The solution is allowed to dwell for approximately 10-20 minutes. If the roof has high levels of fungi, algae and/or other organic matter, additional oxidation solutions (also available from Tremco, Inc.) can be used to facilitate removing the organic matter. As described above, this process can be conducted separately from or combined with the pre-cleaning process described above with reference to block 403.

Block 409 includes the main cleaning process. During this process, the operator rinses and removes soils, for example, using a high pressure rotary cleaning tool, and recovers the wastewater produced by the cleaning process. Fluid can be handled by the fluid handling unit 170. In a representative process, the rotary cleaning tool includes spray jets that spin at the rate of approximately 1,500 rpm or more to evenly distribute the heated cleaning fluid over the roof surface. This portion of the overall process can include recovering at least 90% of the cleaning solution dispensed on the roof during the cleaning operation.

Block 411 includes filtering the waste fluid produced by the cleaning process conducted at block 409. For example, block 411 can include pre-filtering large debris from the waste fluid, before the waste fluid is removed from the roof. The waste fluid removed from the roof is then collected on the ground, as indicated at block 413. In block 415, the waste fluid (which is primarily water) is disposed of, for example, by releasing the waste fluid to a sanitary sewer.

Figure 5A:
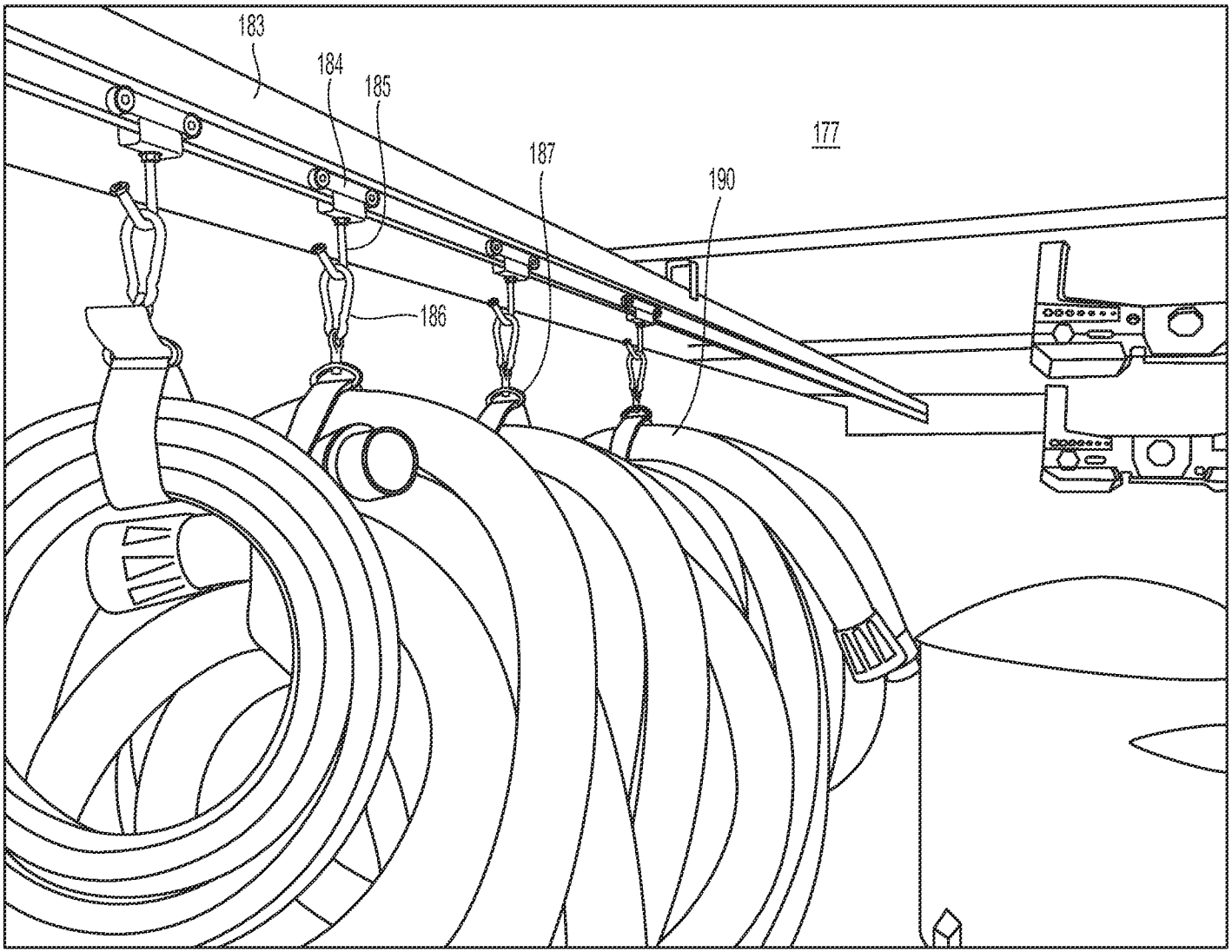
FIG. 5A illustrates a side view of a truck-mounted rack for movably and removably carrying hoses and/or other equipment used for roof cleaning in accordance with an embodiment of the present technology.

FIG. 5A is an isometric illustration of the interior of a representative truck 177, configured to house the fluid handling unit 170 (not visible in FIG. 5A) and a hose rack 183 in accordance with a particular embodiment of the present technology. The rack 183 can include a "C" channel, an "I" channel, and/or another suitable arrangement along which multiple carriages 184 are located. The carriages 184 can include wheels or other elements that allow them to be moved along the rack 183. Each carriage 184 can include a hook 185 or other retainer that removably supports one or more corresponding hoses 190. Each hose 190 can be coiled and held in position via a strap 187, to which is attached a carabiner 186 or other suitable device that can be easily and removably engaged with the hook 185. The carriages 184 can support vacuum hoses, high pressure cleaning fluid hoses, electrical lines, coiled ropes, and/or other equipment that is otherwise bulky and/or difficult to access and move.

Figure 5B:
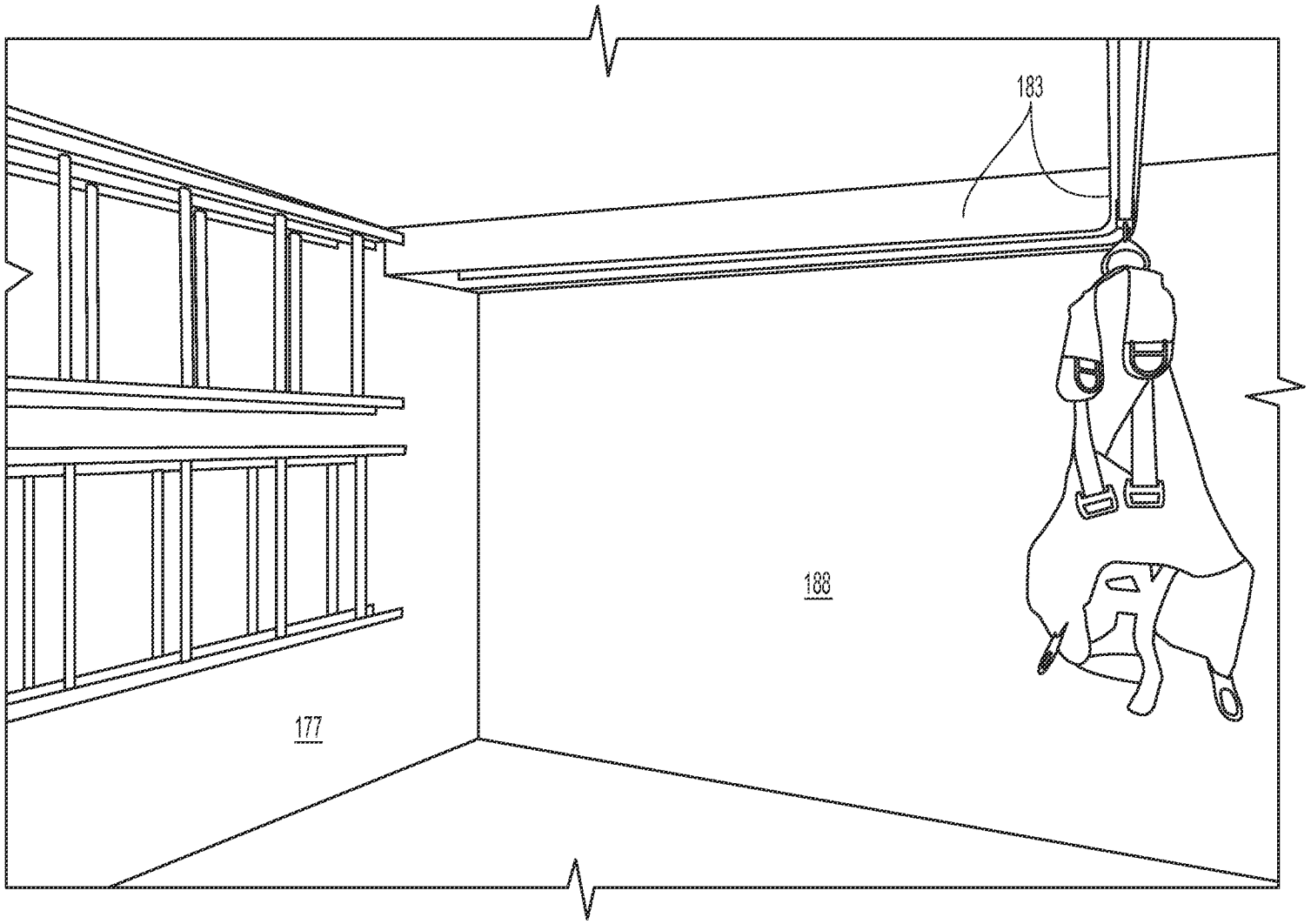
FIG. 5B illustrates an end view of the truck-mounted rack shown in FIG. 5A.

The portion of the hose rack 183 shown in FIG. 5A extends lengthwise through the cargo bay of the truck 177. As shown in FIG. 5B, the rack 183 can curve through 90° so as to pass along the open rear end 188 of the cargo bay, which allows each hose or other piece of equipment to be easily removed from the truck 177 and replaced in the truck when the cleaning process is complete.

Figure 6A:
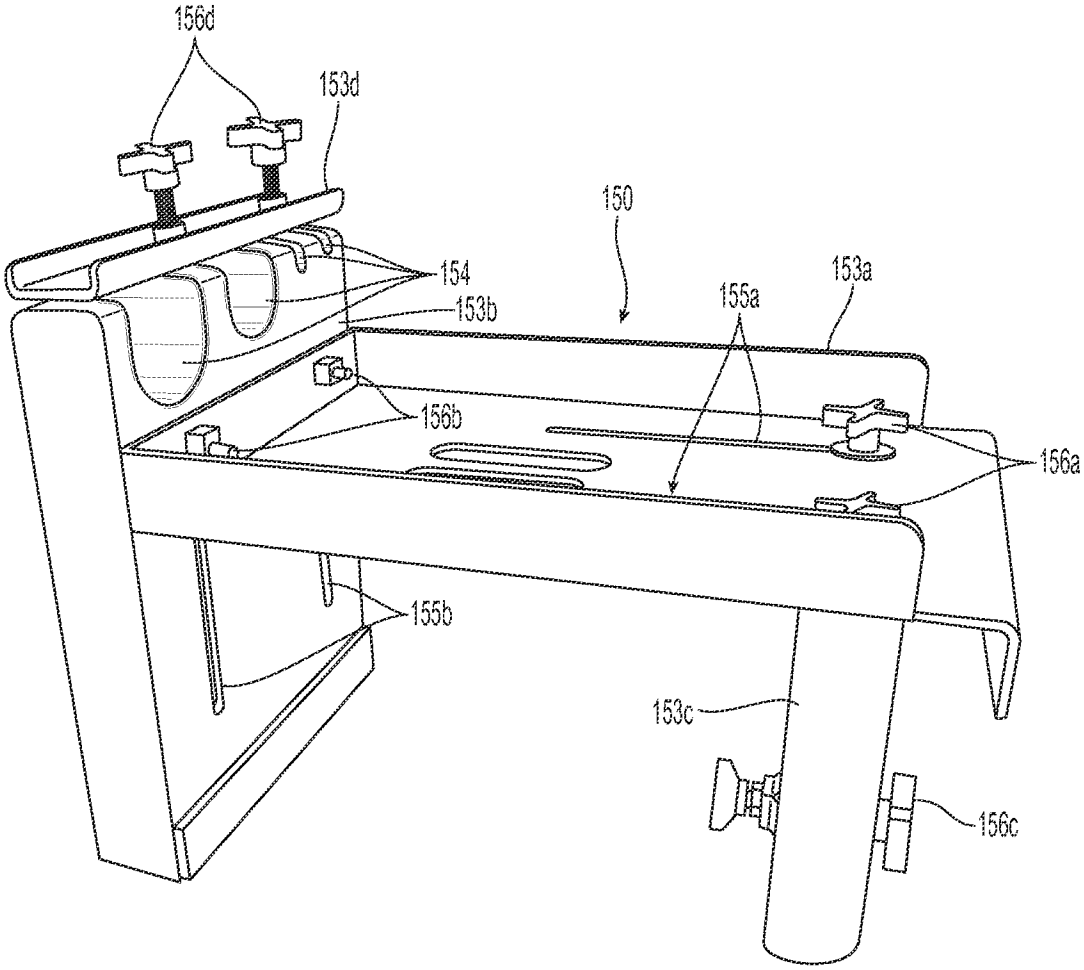
FIG. 6A is an end view of a representative retainer for supporting roof-cleaning equipment during operation, in accordance with an embodiment of the present technology.
Figure 6B:
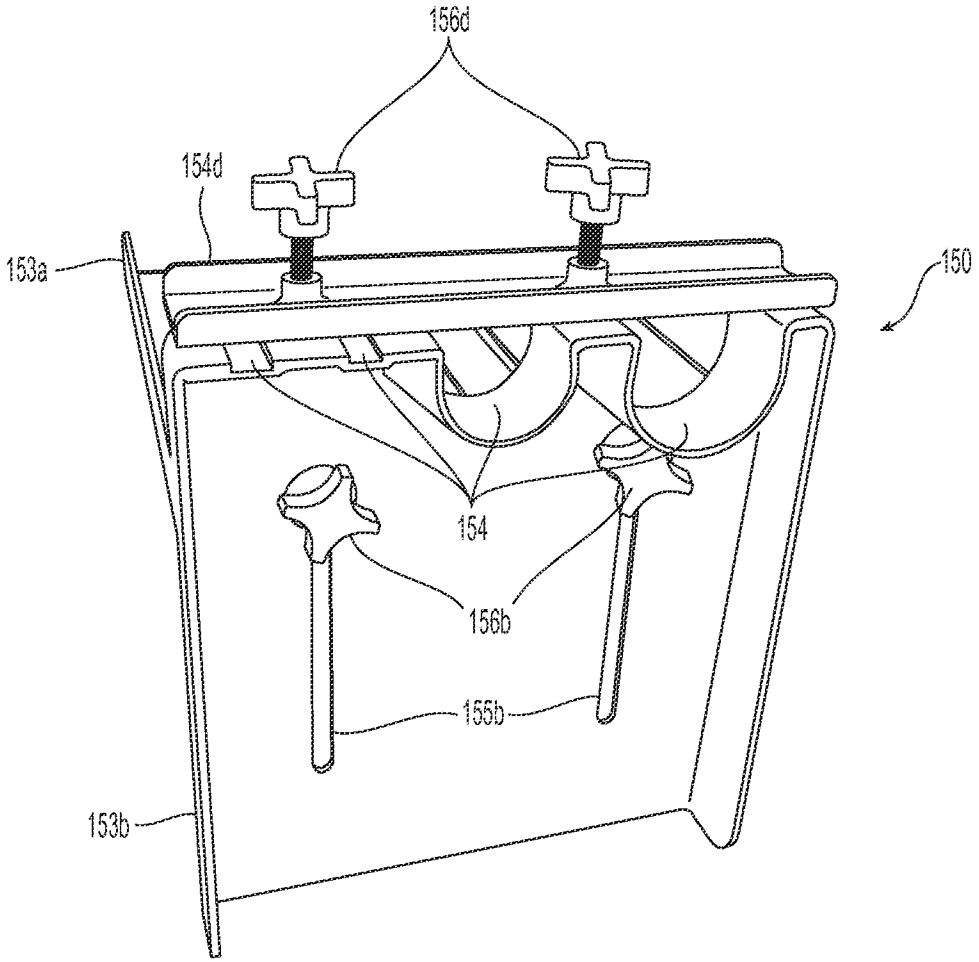
FIG. 6B is an end view of an embodiment of the retainer shown in FIG. 6A.

FIGS. 6A and 6B illustrate a representative retainer 150 configured in accordance with an embodiment of the present technology. Referring first to FIG. 6A, the retainer 150 can include multiple members 153, illustrated as a first member 153*a*, a second member 153*b*, and a third member 153*c*. The first member 153*a* can be sized to extend over the upper edge of the parapet 113 shown in FIG. 1, and the second and third members 153*b*, 153*c* can be configured to hang down along opposing sides of the parapet 113. The second member 153*b* can include multiple access slots 154 that are sized to receive vacuum hoses, water lines, signal lines, and/or other elongated elements that pass between the roof and the ground during normal operations. The retainer 150 can further include a clamp member 153*d* that is secured to the second member 153*b* via one or more clamp screws 156*d*. The clamp screws 156*d* can be tightened or loosened as needed to secure or release the hoses or other lines.

The retainer 150 can be configured to be adjustable so as to fit on a variety of roofs and associated parapets 113. Accordingly, the first member 153*a* can include one or more first positioning slots 155*a* and corresponding first positioning screws 156*a* that allow the third member 153*c* to be moved relative to the first member 153*a*. The second member 153*b* can include one or more second positioning slots 155*b* and corresponding second positioning screws 156*b* that allow the second member 153*b* to be moved relative to the first member 153*a*. Once the first-third members 153*a*-153*c* are properly positioned, the operator can tighten a securing screw 156*c* or other suitable device to clamp the retainer 150 as a whole in position relative to the parapet 113.

FIG. 6B is an end view of the retainer 150 shown in FIG. 6A, further illustrating the second member 153*b* and the associated second positioning slots 155*b* and second positioning screws 156*b*.

Figure 7A:
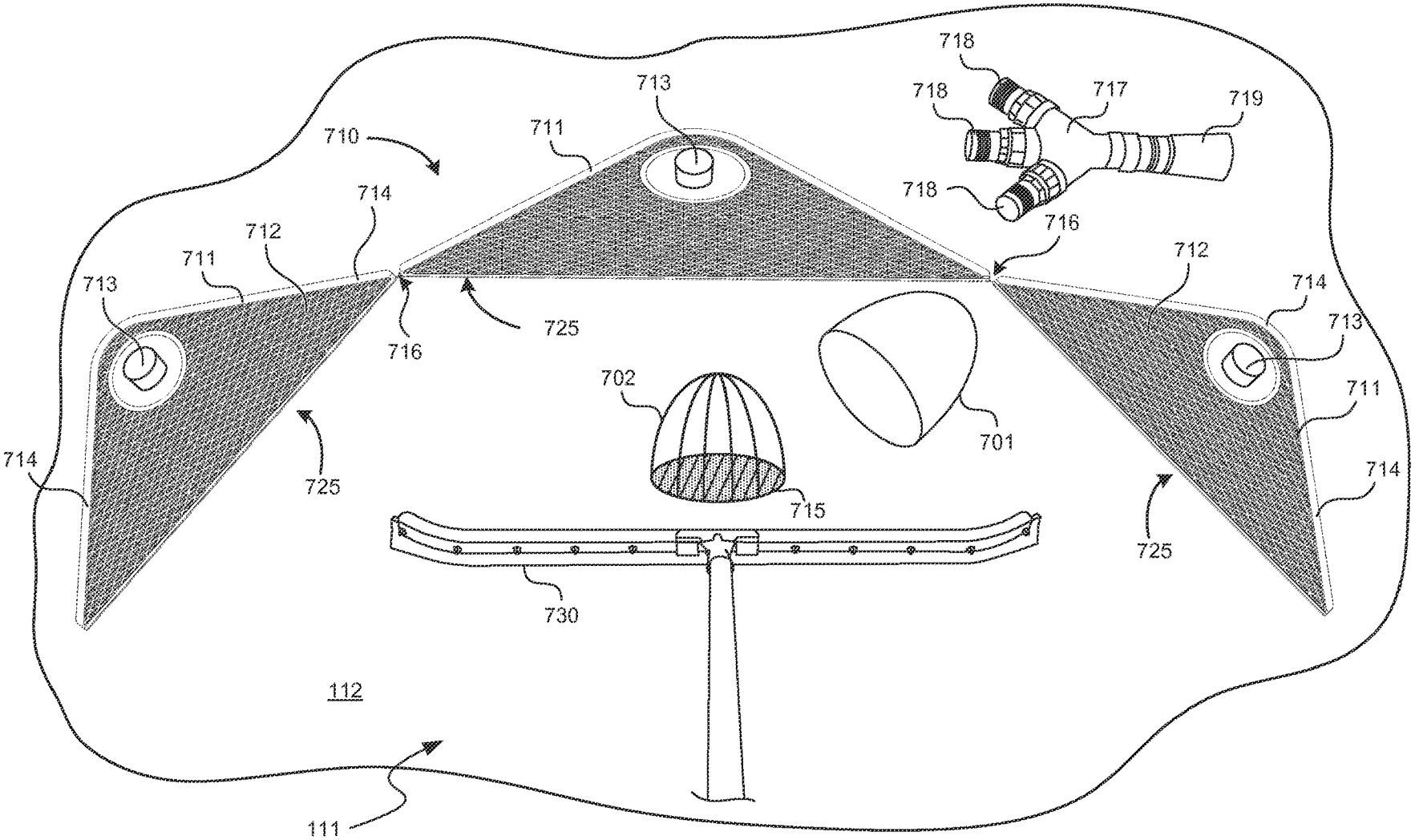
FIG. 7A is a partially schematic, isometric illustration of a barrier positioned to collect water from a roof surface in accordance with an embodiment of the present technology.

FIG. 7A is a partially schematic illustration of a barrier 710 positioned on a roof surface 112 in accordance with a particular embodiment of the present technology. The barrier 710 can be positioned in a low portion of the roof 111, e.g., around or near a drain 715 in the roof surface 112. The drain 715 itself can include a drain grate 702 positioned to prevent debris from going down the drain 715. The overall system can include a bonnet or cover 701 positioned over the drain grate 702 to prevent water from passing into the drain 715. Instead, the barrier 710 can collect the water that would otherwise descend down the drain 715, and allow the water to be evacuated as described in further detail below.

In a particular embodiment, the barrier 710 includes multiple (e.g., three) barrier portions 711, with adjacent barrier portions connected via connections 716 to form the overall barrier 710. The connections 716 can allow individual barrier portions 711 to be removed from each other or folded upon each other for stowage. Each barrier portion 711 can include a cover 712 that has an offset position from the roof surface 112 as a result of downwardly extending sidewalls 714. In a particular embodiment, the sidewalls 714 are not continuous around the periphery of the cover 712, so as to leave an entrance opening 725 in each barrier portion 711. As a result, water can pass under the cover 712 through the entrance opening 725.

To remove the water flowing into each barrier portion 711, the barrier portions 711 can include an evacuation port 713. Individual evacuation ports 713 can be connected to a manifold 717 (having corresponding manifold ports 718) with flexible or other tubing (not shown in FIG. 7A). The manifold 717 can further include a vacuum connector 719 which can be connected to a vacuum source, e.g., the fluid handling unit 170 (FIG. 1), via a drain vacuum line 190*b* (FIG. 1). In operation, the fluid on the roof surface 112 can drain toward the barrier 711 under the force of gravity, with or without the aid of a user-operated squeegee 730.

Figure 7B:
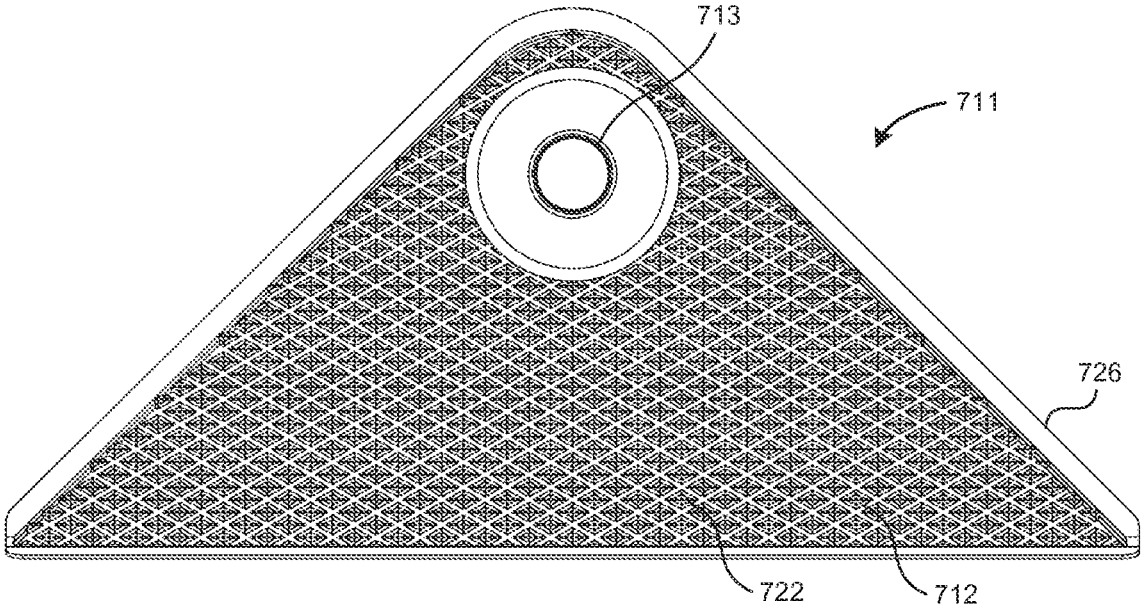
FIG. 7B is a top view of a portion of the barrier shown in FIG. 7A and configured in accordance with an embodiment of the present technology.

FIG. 7B is a more detailed, top view of a representative barrier portion 711 configured in accordance with a particular embodiment of the present technology. The barrier portion 711 can include an outer rim 726 from which the sidewall 714 (FIG. 7A) extends downwardly. An upper surface 722 of the cover 712 can include a series of ribs and recesses positioned, for example, in a waffle configuration, to provide structural rigidity with relatively low weight. The purpose of the enhanced structural rigidity is to prevent the cover 712 from sucking down onto the surface of the roof when a vacuum is applied to the vacuum port 713.

Figure 7C:
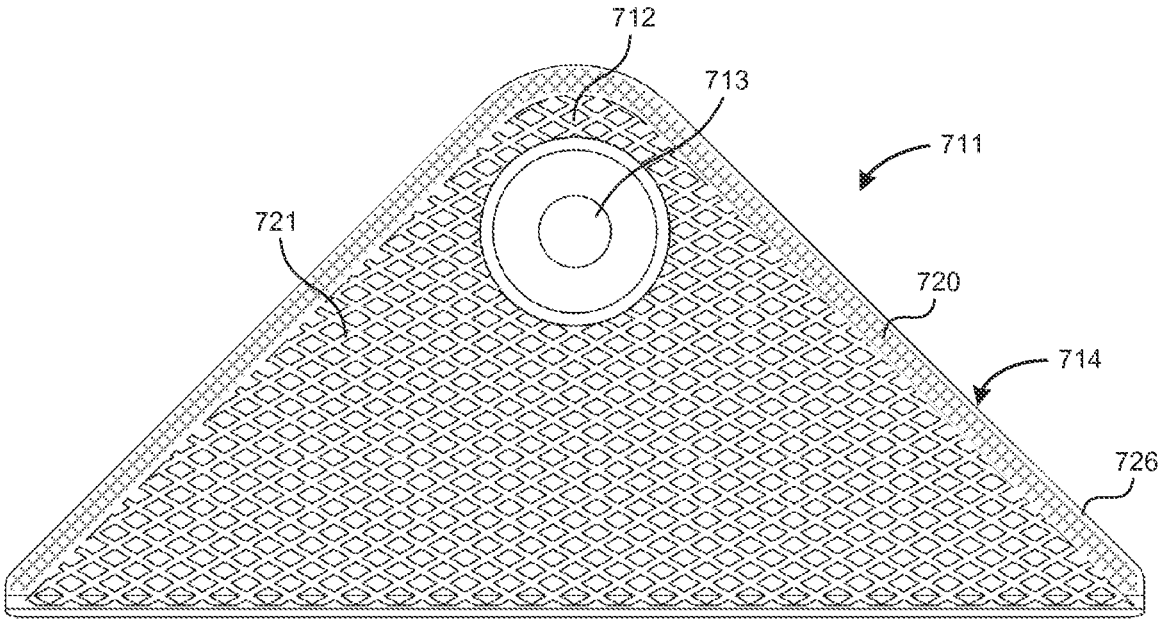
FIG. 7C is a partially schematic, bottom view of an embodiment of the barrier portion shown in FIG. 7B.

FIG. 7C is a bottom view, looking upwardly at an under surface 721 of the barrier portion 711. As shown in FIG. 7C, the barrier portion 711 can include a seal 720, attached directly to the rim 726 or to the downwardly extending sidewall 714. The seal 720 can have a flexible construction so as to form a watertight or at least approximately watertight seal against the surface of the roof, thus providing for more efficient evacuation of the water through the evacuation port 713.

In particular embodiments, the barrier portion 711 can have a generally triangular configuration, as shown in FIG. 7A-7C. In other embodiments, the barrier portion 711 can have other shapes that generally include at least one sidewall or seal, and at least one entrance opening 725. In an embodiment shown in FIG. 7A, three barrier portions 711 are used to form a single barrier. In other embodiments, other numbers of barrier portions 711 that can be positioned to similarly form a partially enclosed space around a drain 715 or other location on the roof's surface 112.

One feature in at least some of the methods and systems described above is that they can include or facilitate collecting wastewater produced by a roof cleaning operation without discharging untreated water directly into the environment. Instead, a significant majority of (e.g., 90% or more) of the wastewater can be removed from the surface of the roof, filtered, and then discharged into a sanitary sewer, which is in turn coupled to a suitable wastewater treatment plant. One advantage of this approach is that it can reduce the environmental impact of the roof cleaning process. Another advantage of this approach is that it can reduce the amount of water used to clean the roof, e.g., at the time the water is dispensed (because it is dispensed in a controlled manner), and/or because some or all of the water may be reclaimed after it is treated. For example, the water reclaimed from wastewater treatment plants can be used for agricultural and/or other purposes.

Another feature of at least some of the foregoing methods and associated systems is that they do not rely on surfactants or detergents (which can be environmentally harmful) to produce superior cleaning results. Instead, high pressure cleaners (e.g., rotary cleaners) can effectively remove dirt, debris, fungi, algae and/or other contaminants from the roof surface using cleaning fluids that do not contain harmful detergents or surfactants.

Still another feature of at least some of the foregoing embodiments is that multiple functions can be combined in a single operation and/or can be performed with a single piece of equipment. For example, as discussed above, the sweeping process can be combined with the process of dispensing a pre-cleaning solution to reduce the time required to conduct both operations.

Yet a further feature of at least some of the foregoing embodiments is that the system can include time-saving features that reduce the cost and therefore the expense of the roof cleaning process. For example, embodiments of the retainer described above can reduce the likelihood for hoses, vacuum lines, and/or signal lines to become dislodged during a roof cleaning process. Embodiments of the rack system described above can facilitate the process of selecting the correct hoses and easily removing and replacing the hoses from a truck or other vehicle used to provide the equipment to a job site.

An overarching result of any one or combination of the foregoing features is that the process of cleaning a roof can be faster, more efficient, and/or more environmentally friendly than conventional processes. As a result, restoring a roof to its intended reflectivity (and therefore energy savings level) can be easier and cheaper and therefore used more frequently. In addition to or in lieu of the foregoing benefits, more frequent cleaning can increase the likelihood for the roof maintenance process to comply with warranty requirements imposed by roof manufacturers and/or installers.

From the foregoing, it will be appreciated that specific embodiments of the technology have been described herein for purposes of illustration, but that various modifications may be made without deviating from the technology. For example, components of the fluid handling unit can be consolidated, e.g., into a single vehicle (as described above), or can be distributed in other embodiments. These components can be housed in a truck, as discussed above, or another vehicle, and in some embodiments can be removed from the vehicle during operation. In particular embodiments, the water used to clean the roof can be heated after being pressurized, as discussed above, and in other embodiments, the water can be heated prior to being pressurized. The roof cleaner can be a rotary cleaner in particular embodiments, and can have other configurations in other embodiments. While particular aspects of the processes can have certain advantages when applied to roofs in warm or hot climates, many of the advantages described above can apply to roofs in cool or temperate climates. While particular embodiments of the foregoing techniques avoid the use of surfactants, in other embodiments, surfactants may be used to remove particularly stubborn debris. For example, in the Southeastern United States, red clay dust can adhere to roof surfaces so strongly that surfactants are at least beneficial and in some cases necessary to remove it. In such cases, the foregoing techniques for capturing the cleaning fluid can be used to prevent untreated surfactants from entering the environment. Embodiments of the barrier described above can have a single unitary portion rather than multiple detachable portions, for example, in cases where a compact, stowed configuration is not used. In other embodiments, not every barrier portion includes a vacuum port, and instead, a single vacuum port can receive water from multiple barrier portions.

Certain aspects of the technology described in the context of particular embodiments may be combined or eliminated in other embodiments. For example, aspects of the technology can be practiced without the retainer and/or hose racks described above. The roof surface water collection devices and methods described above can be used in combination with the foregoing roof cleaning devices and methods, or each can be used independently of the other. Further, while advantages associated with certain embodiments of the technology have been described in the context of those embodiments, other embodiments may also exhibit such advantages, and not all embodiments need necessarily exhibit such advantages to fall within the scope of the present technology. Accordingly, the disclosure and associated technology can encompass other embodiments not expressly shown or described herein.

We claim:

1. A method for cleaning a roof, comprising:

blocking a drain on the roof, wherein the roof includes a parapet disposed around at least a portion of an upwardly facing surface of the roof;

sweeping the roof;

heating and pressurizing a cleaning fluid on the ground;

releasably securing a retainer to the parapet, wherein the retainer has an adjustable width, and wherein releasably securing the retainer includes adjusting the width to fit the parapet, and wherein the retainer includes a first member, a second member, and a third member, and wherein the first member includes a first elongated positioning slot configured to enable the third member to be moved relative to the first member, and wherein the second member includes a second elongated positioning slot configured to enable the second member to be moved relative to the first member, and wherein releasably securing the retainer to the parapet includes clamping the retainer to the parapet by securing a first securing screw in the first elongated positioning slot and securing a second securing screw in the second elongated positioning slot;

directing the heated and pressurized cleaning fluid to a rotary cleaning tool on the roof via the retainer;

using the rotary cleaning tool to direct the heated and pressurized cleaning fluid against the upwardly facing surface of the roof;

applying a vacuum to the cleaning tool to direct used cleaning fluid from the roof to a wastewater tank on the ground; and directing the used cleaning fluid from the wastewater tank into a sanitary sewer.

2. The method of claim 1 wherein applying the vacuum includes operating a blower powered by an internal combustion engine, and wherein heating the cleaning fluid includes transferring heat from a flow of exhaust products generated by the internal combustion engine to the cleaning fluid.

3. The method of claim 1 wherein the cleaning fluid includes no detergents and no surfactants.

4. The method of claim 1, further comprising filtering solids from the used cleaning fluid before directing the used cleaning fluid to the wastewater tank.

5. The method of claim 1, further comprising:

releasably securing a water line to the retainer by positioning the water line in a first access slot of the retainer;

connecting the water line to the cleaning tool;

releasably securing a vacuum line to the retainer by positioning the vacuum line in a second access slot of the retainer; and connecting the vacuum line between the cleaning tool and the wastewater tank;

wherein directing the heated and pressurized cleaning fluid includes directing the heated and pressurized heating fluid through the water line; and wherein applying the vacuum includes applying the vacuum via the vacuum line.

6. The method of claim 1 wherein sweeping the roof includes sweeping the roof with a sweeping tool, and wherein the method further comprises dispensing a pre-cleaning fluid from the sweeping tool onto the upwardly facing surface of the roof before directing the heated and pressurized cleaning fluid against the upwardly facing surface.

7. A method for cleaning a roof, having a parapet disposed around at least a portion of an upwardly facing surface of the roof, the method comprising:

releasably securing a retainer to the parapet, wherein the retainer has an adjustable width, and wherein releasably securing the retainer includes adjusting the width such to fit the parapet, and wherein the retainer includes a first member, a second member and a third member, and wherein the first member includes a first elongated positioning slot configured to enable the third member to be moved relative to the first member, and wherein the second member includes a second elongated positioning slot configured to enable the second member to be moved relative to the first member, and wherein releasably securing the retainer to the parapet includes clamping the retainer to the parapet by securing a first securing screw in the first elongated positioning slot and securing a second securing screw in the second elongated positioning slot;

dispensing a cleaning fluid on the roof via the retainer;

at least restricting the cleaning fluid from exiting the roof via a roof drain; and collecting the cleaning fluid from the roof and directing the cleaning fluid to a sanitary sewer.

8. The method of claim 7 wherein dispensing the cleaning fluid includes dispensing the cleaning fluid with a rotary cleaning tool, and wherein the method further comprises applying a vacuum to the cleaning tool to direct used cleaning fluid from the roof to a wastewater tank on the ground.

9. The method of claim 7, further comprising heating and pressurizing the cleaning fluid prior to dispensing the cleaning fluid on the roof.

10. The method of claim 7 wherein at least restricting the cleaning fluid from exiting the roof includes covering a roof drain.

11. The method of claim 10, further comprising:

positioning a barrier around at least a portion of the roof drain, with a cover of the barrier offset away from the upper surface of the roof;

allowing water to pass under the cover of the barrier; and wherein collecting the cleaning fluid includes drawing a vacuum on an evacuation port through the cover of the barrier, while preventing the cover from drawing down onto the upper surface of the roof.

12. The method of claim 1, wherein the parapet projects upwardly from the upwardly facing surface of the roof, and wherein:

releasably securing the retainer to the parapet includes:

positioning the first member over an upper edge of the parapet;

positioning the second and third members of the retainer on opposite sides of the parapet; and clamping the parapet between the second and third members.

13. The method of claim 1, further comprising:

positioning a barrier around at least a portion of the roof drain, with a cover of the barrier offset away from the upper surface of the roof;

allowing water to pass under the cover of the barrier; and collecting additional used cleaning fluid by drawing a vacuum on an evacuation port through the cover of the barrier, while preventing the cover from drawing down onto the upper surface of the roof.

14. A method for cleaning a roof having an upwardly facing surface and a parapet disposed around at least a portion of the upwardly facing surface, wherein the method, comprises;

blocking a drain on the roof;

sweeping the roof;

releasably securing a retainer to the parapet, wherein the retainer has an adjustable width, and wherein releasably securing the retainer includes adjusting the width to fit the parapet, and wherein the retainer includes a first member, a second member and a third member, and wherein the first member includes a first elongated positioning slot configured to enable the third member to be moved relative to the first member, and wherein the second member includes a second elongated positioning slot configured to enable the second member to be moved relative to the first member, and wherein releasably securing the retainer to the parapet includes clamping the retainer to the parapet by securing a first securing screw in the first elongated positioning slot and securing a second securing screw in the second elongated positioning slot;

releasably securing a water line to the retainer;

connecting the water line to a cleaning tool on the roof;

releasably securing a vacuum line to the retainer;

connecting the vacuum line between the cleaning tool and a wastewater tank on the ground;

heating and pressurizing a cleaning fluid on the ground;

directing the heated and pressurized cleaning fluid to the cleaning tool on the roof, via the water line;

using the cleaning tool to direct the heated and pressurized cleaning fluid against an upwardly facing surface of the roof;

applying a vacuum to the cleaning tool via the vacuum line to direct used cleaning fluid from the roof to the wastewater tank on the ground; and directing the used cleaning fluid from the wastewater tank into a sanitary sewer.

15. The method of claim 1, wherein the second member is configured to hang down along a side of the parapet, and wherein the third member is configured to hang down along an opposing side of the parapet, and wherein releasably securing the retainer to the parapet includes:

adjusting a location of the first member; and adjusting a location of the second member.

16. The method of claim 7, wherein the second member is configured to hang down along a side of the parapet, and wherein the third member is configured to hang down along an opposing side of the parapet, and wherein releasably securing the retainer to the parapet includes:

adjusting a location of the first member; and adjusting a location of the second member.

17. The method of claim 14, wherein the second member is configured to hang down along a side of the parapet, and wherein the third member is configured to hang down along an opposing side of the parapet, and wherein releasably securing the retainer to the parapet includes:

adjusting a location of the first member; and adjusting a location of the second member.

* * * * *